US007111653B2

(12) United States Patent
Cnossen et al.

(10) Patent No.: US 7,111,653 B2
(45) Date of Patent: Sep. 26, 2006

(54) EXPANSION TANK

(75) Inventors: Jan Henk Cnossen, Koudum (NL); Jan Hendrik Timmerman, Gouda (NL); Dimitri Wasil Kemper, Amsterdam (NL); Jan Postma, Hendrik Ido Ambacht (NL)

(73) Assignee: Flamco B.V., Gouda (NL)

( * ) Notice: Subject to any disclaimer, the term of this patent is extended or adjusted under 35 U.S.C. 154(b) by 207 days.

(21) Appl. No.: 10/859,595

(22) Filed: Jun. 3, 2004

(65) Prior Publication Data

US 2005/0022896 A1 Feb. 3, 2005

(30) Foreign Application Priority Data

Jun. 4, 2003 (NL) ..... 1023595

(51) Int. Cl.
*B65B 1/04* (2006.01)

(52) U.S. Cl. ..... 141/351; 141/114; 141/361; 141/25; 138/30; 137/505.2; 220/530

(58) Field of Classification Search ..... 141/351, 141/360–363, 114, 383, 384; 137/505.19, 137/505.2; 220/530, 529; 138/30
See application file for complete search history.

(56) References Cited

U.S. PATENT DOCUMENTS 3,929,163 A * 12/1975 Schon ..... 138/30
4,732,319 A * 3/1988 Schurter et al. ..... 237/65

FOREIGN PATENT DOCUMENTS

| | | |
|---|---|---|
| DE | 21 51 905 | 4/1973 |
| DE | 29 22 302 | 12/1980 |
| DE | 85 33 612.2 | 4/1986 |

* cited by examiner

*Primary Examiner*—Timothy L. Maust
(74) *Attorney, Agent, or Firm*—Browdy and Neimark, PLLC

(57) ABSTRACT

An expansion tank (1) which is intended to be connected to a pipe system which is filled or is to be filled with liquid, comprises a substantially closed tank (2) having at least a first connection opening (6) for connection to a liquid pipe, a second connection opening for connection to a source of pressurized gas (14), and an element (8) which can move inside the tank and is designed to move with the interface (11) between liquid (9) and gas (10) in the tank. The tank is provided, at the location of the second connection opening, with a valve assembly (7) which can open and close the second connection opening and can be actuated by the movable element (8) in the tank.

Figure 1:
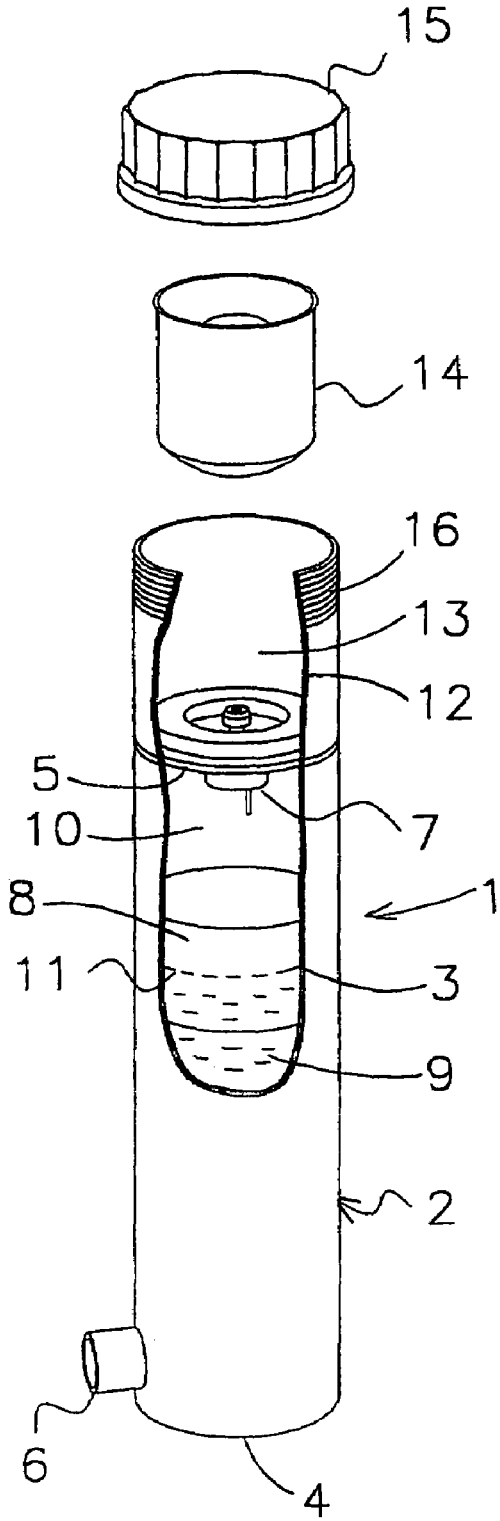

9 Claims, 6 Drawing Sheets a.

b.

EXPANSION TANK

The application relates to an expansion tank which is intended to be connected to a pipe system which is filled or is to be filled with liquid, comprising a substantially closed tank having at least a first connection opening for connection to a liquid pipe, a second connection opening for connection to a source of pressurized gas, and an element which can move inside the tank and is designed to move with the interface between liquid and gas in the tank.

Various embodiments of an expansion tank of this type are known. An expansion tank is used in a liquid-filled pipe system in order to keep the pressure within defined limits, and preferably as constant as possible, in the event of a change in the volume of the liquid in the pipe system to which the expansion tank is connected. During normal operation, in which an expansion tank is connected to a liquid-filled pipe system, the expansion tank is partially filled with liquid and partially filled with a pressurized gas. The pressure of the gas in the expansion tank is equal to the pressure of the liquid in the tank and in the pipe system. In certain embodiments of the expansion tank, the liquid and the gas are in direct contact with one another. In other embodiments, there is a separating element, which may take various forms, for example the form of a flexible membrane or a rigid separating element which can move in the longitudinal direction of the tank, between the liquid and the gas. A separating element of this type moves with the interface between liquid and gas in the tank, so that the separating element per se can be considered as a movable element which is designed to move with the interface between liquid and gas in the tank. An element which floats on the liquid present in the tank, i.e. a float, can also be considered as a movable element of this type. To keep the pressure within certain limits, and preferably as constant as possible, in the event of a change in the volume of the liquid in the pipe system to which the expansion tank is connected, it is necessary for the volume of the pressurized gas which is present in the tank to be at a certain minimum level.

The volume of the gas which is present in the tank may decrease over the course of time as a result of gas being taken up in the liquid or as a result of gas diffusing through the membrane or leaking out in other ways. To restore good operation of the expansion tank, it is necessary to top up the quantity of pressurized gas in the expansion tank. This represents a laborious operation and in certain cases is indeed impossible. In the latter case, a new expansion tank has to be installed.

It is an object of the invention to provide an expansion tank which does not have the abovementioned drawback and in which the required volume of pressurized gas is always present in the expansion tank.

This object is achieved, according to the invention, by an expansion tank of the type described in the preamble which is characterized in that the tank is provided, at the location of the second connection opening, with a valve assembly which can open and close the second connection opening and can be actuated by the movable element in the tank.

When an expansion tank according to the invention is in use, with the tank connected by means of the first connection opening to a liquid-filled pipe system and a source of pressurized gas being connected to the second connection opening, if the quantity of pressurized gas drops, the element which can move with the interface between liquid and gas will actuate the valve assembly at a given instant. As a result, the second connection opening is opened and pressurized gas flows from the source into the tank. In this way, the quantity of pressurized gas in the expansion tank is automatically topped up.

Preferred embodiments of the expansion tank according to the invention are defined in the subclaims.

Figure 2:
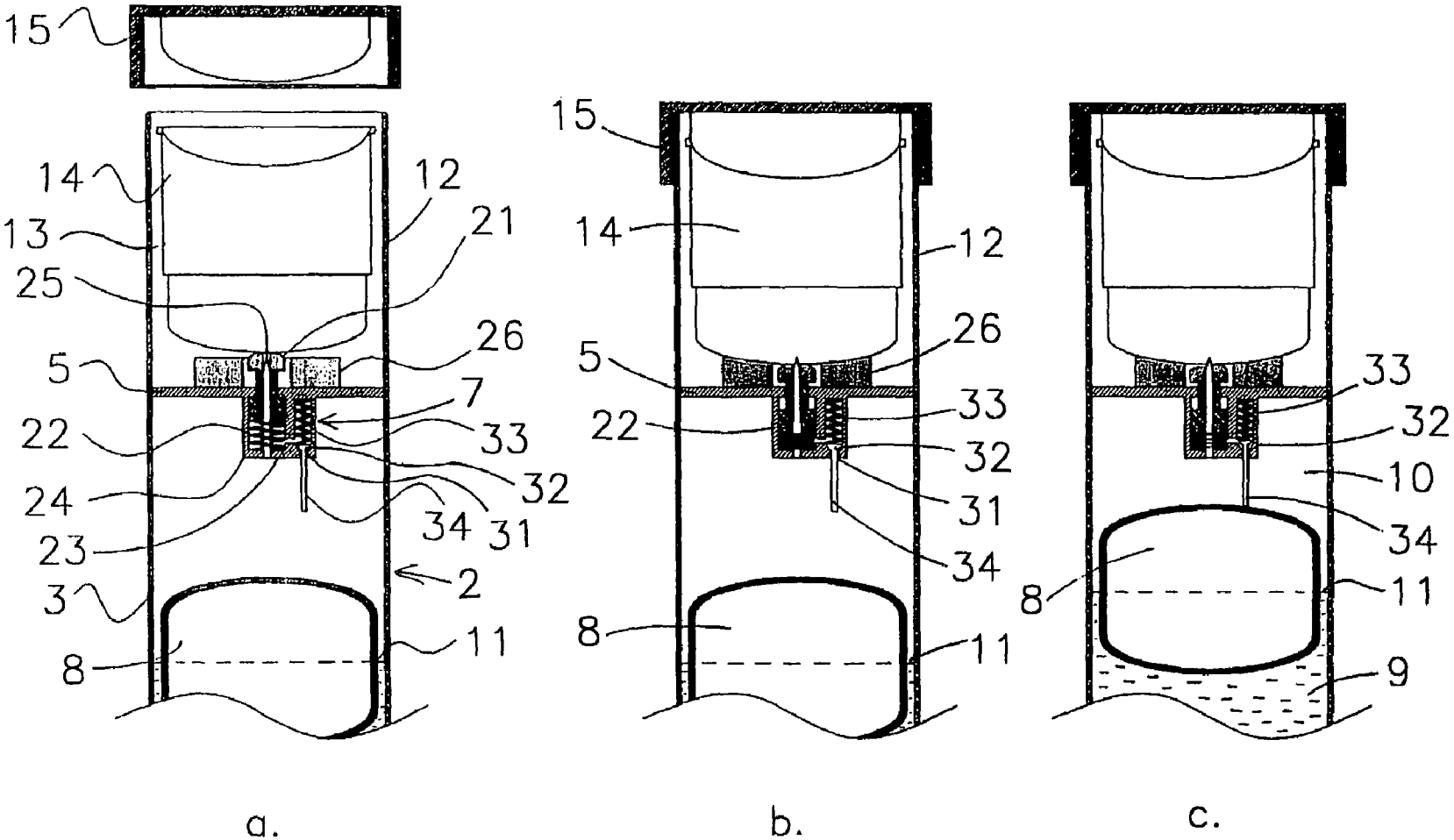
Figure 3:
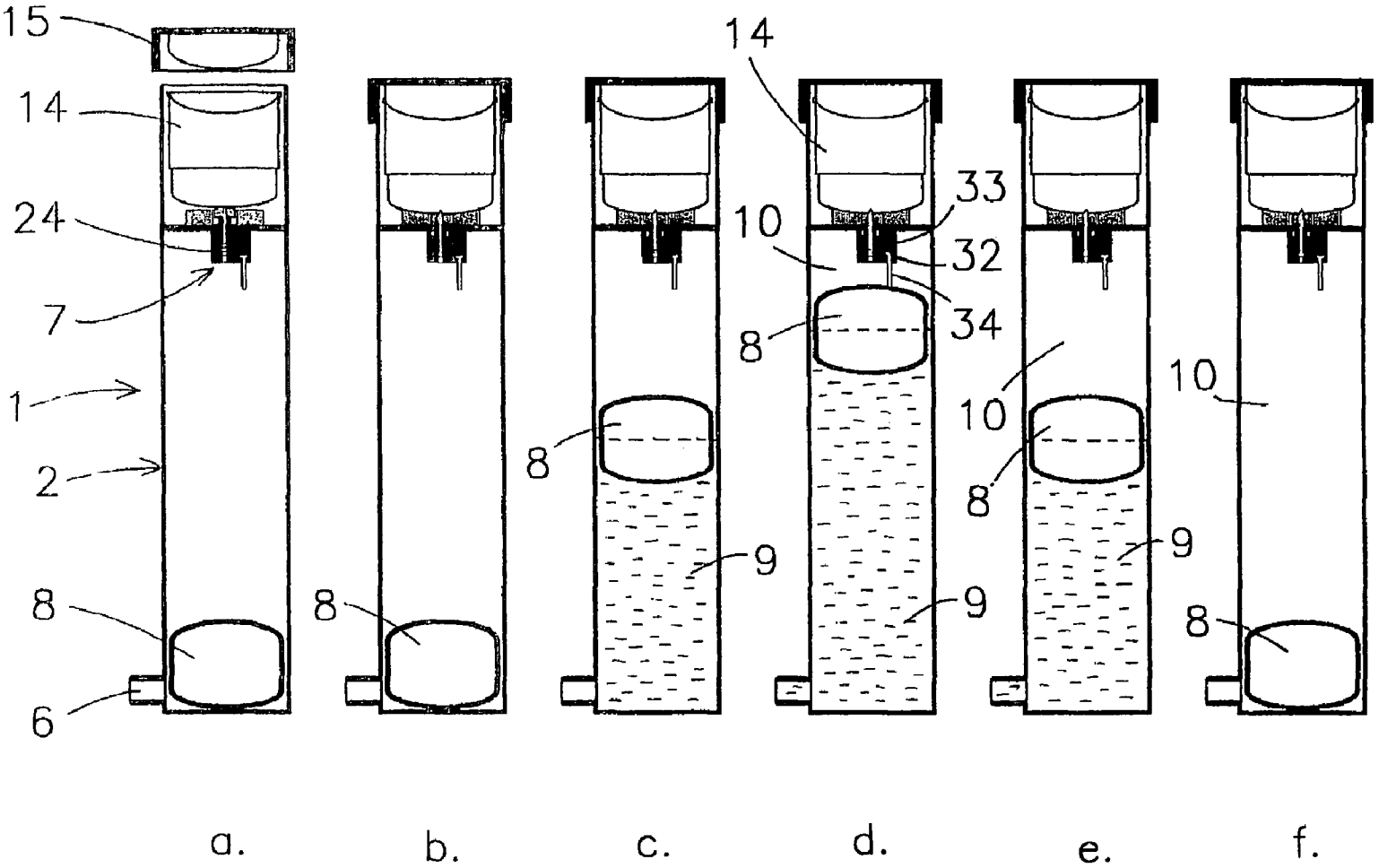
Figure 4:
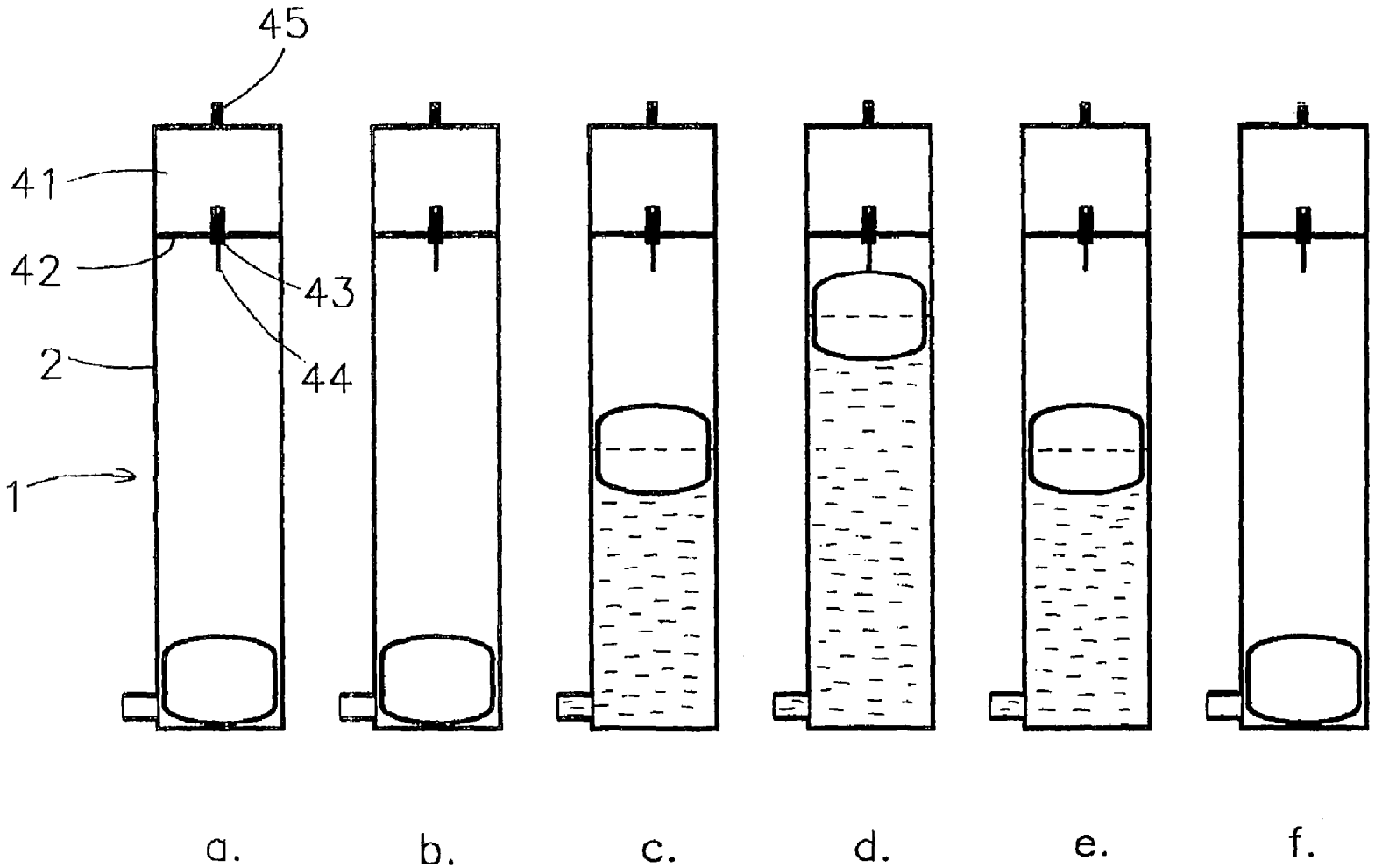
Figure 5:
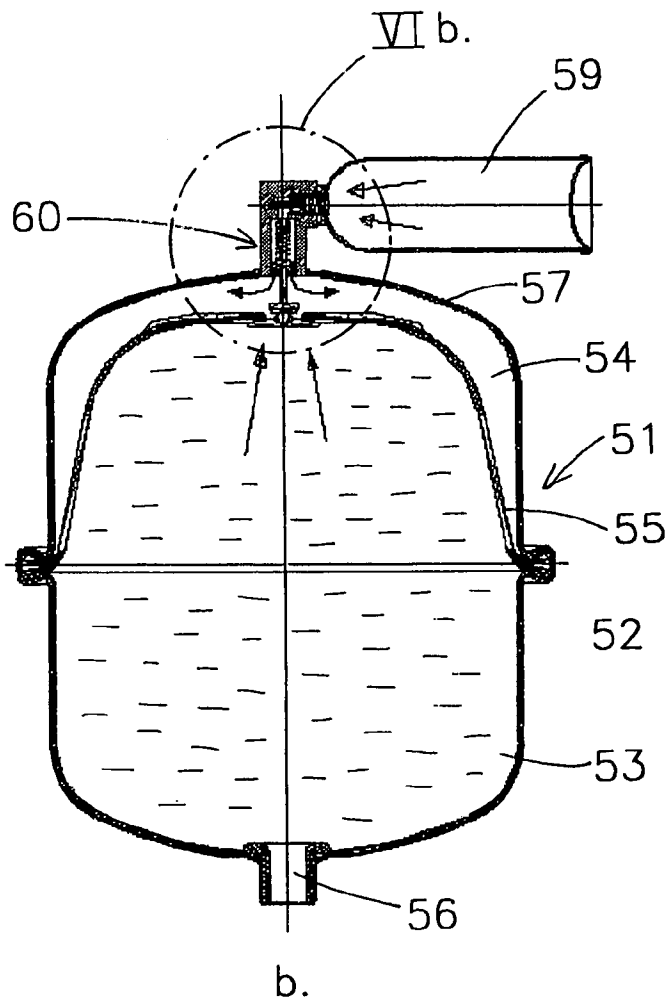
Figure 5:
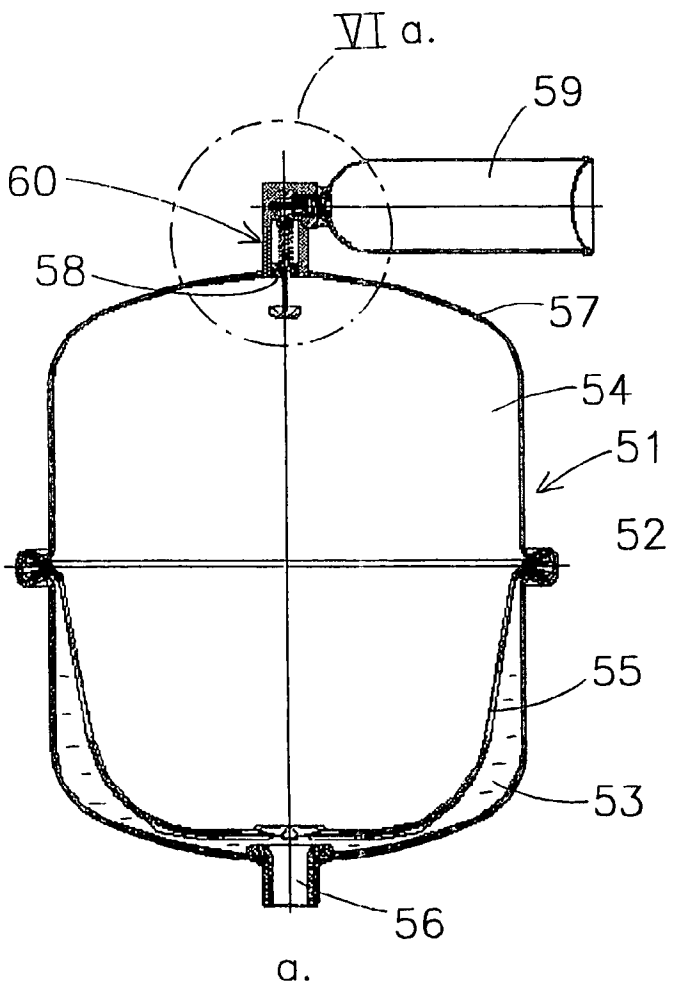
Figure 6:
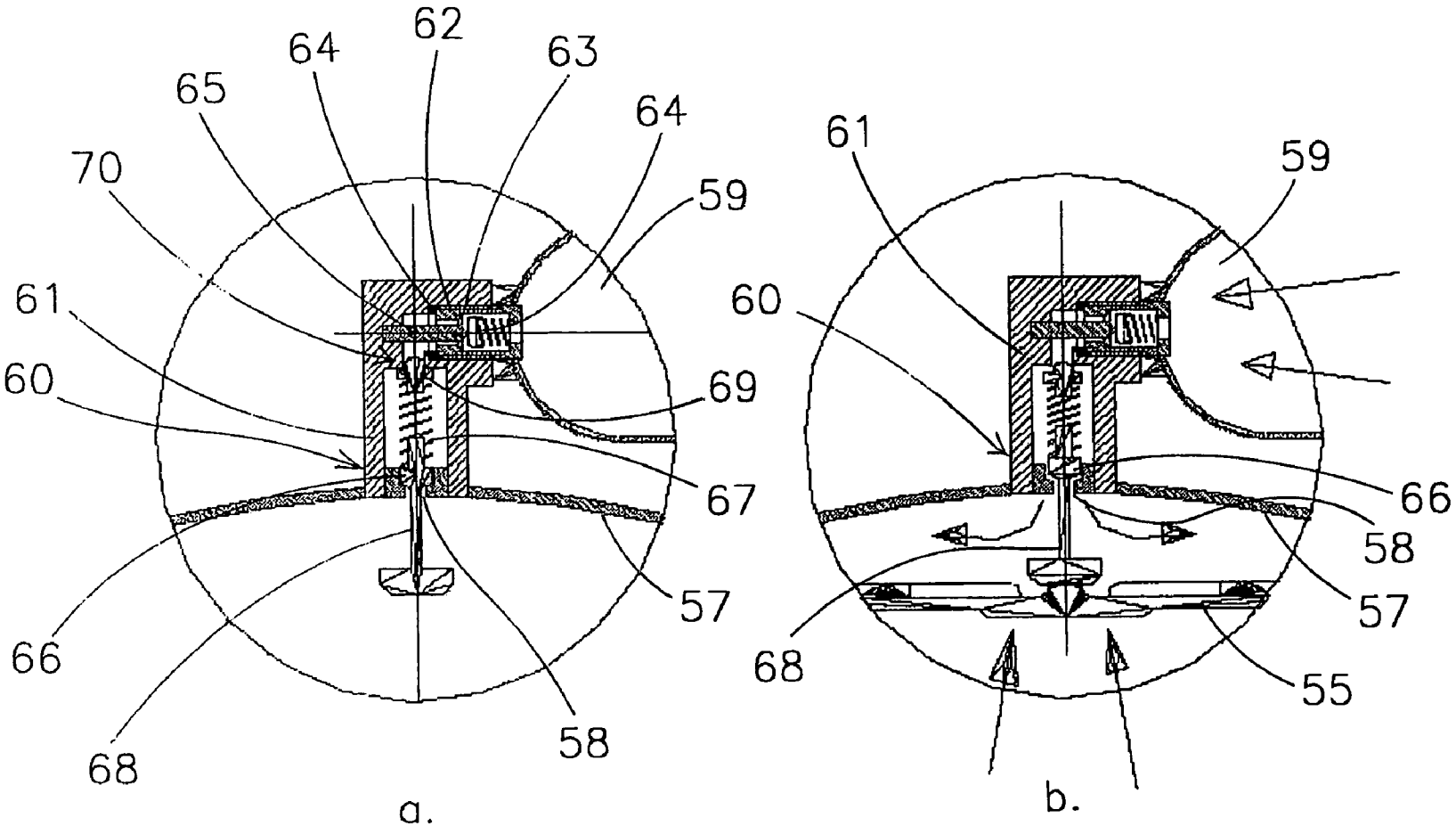

The invention will be explained in more detail in the following description of a number of embodiments of the expansion tank according to the invention with reference to the drawing, in which:

FIG. 1 shows a specific embodiment of the expansion tank according to the invention, partly in the form of an exploded view;

FIGS. 2*a–c* show cross sections through the top part of the expansion tank from FIG. 1 in various states;

FIGS. 3*a–f* show the operation of the expansion tank from FIG. 1;

FIGS. 4*a–f*, similarly to FIGS. 3*a–f*, show the operation of a slightly different embodiment of the expansion tank according to the invention;

FIGS. 5*a,b* show cross sections through yet another embodiment of the expansion tank according to the invention; and FIGS. 6*a,b* show an enlarged view of details VIa and VIb from FIGS. 5*a,b*.

The expansion tank illustrated in FIG. 1 comprises a substantially closed cylindrical tank 2 having a side wall 3, a base 4 and a top wall 5. In the vicinity of the base 4, a first connection opening 6 is provided in the side wall 3 for connecting the expansion tank 1 to a pipe system (not shown) which is filled or is to be filled with liquid. In the top wall 5 there is a second connection opening for connecting the expansion tank 1 to a source of pressurized gas. This opening can be opened and closed by a valve 7 which is arranged at the location of the second connection opening and the operation of which will be explained below. In the tank there is a float 8, which in the embodiment illustrated functions as a separating element between liquid 9 and gas 10 in the tank. The float 8 floats on the liquid 9 and moves with the liquid level 11, i.e. the interface between liquid 9 and gas 10. The float 8 can actuate the valve assembly 7.

The cylindrical side wall 3 of the tank 2 extends beyond the top wall 5, where it forms a wall part 12 which is integrally connected to the wall of the expansion tank 1 and together with the top wall 5 partially surrounds a space 13. A reservoir 14 containing pressurized gas can be incorporated in the space 13. The space 13 can be closed off by a cover 15. In the embodiment shown, the cover 15 is a screw cover which can be screwed onto the end section 16 of the wall part 12. For this purpose, the cover 15 is provided with an internal screwthread, and the end section 16 is provided with an external screwthread which matches the internal screwthread of the cover 15. When the cover 15 is being screwed onto the wall part 12, a connection is produced, in a manner which is to be described in more detail below, between the interior of the reservoir 14 containing pressurized gas and the second connection opening in the top wall 5. In the embodiment shown, the reservoir 14 is a thin-walled, disposable reservoir.

FIGS. 2*a–c* show a cross section through the top part of the expansion tank from FIG. 1 in various states. These figures also provide a more detailed illustration of the valve assembly 7.

In FIG. 2*a*, the reservoir 14 containing pressurized gas is positioned in the space 13. The reservoir 14 rests on a plunger 21, which extends through a bore in the top wall 5 of the tank 2 and can be moved in the axial direction. The plunger 21 is pressed upwards by a spring 22 which is supported at the underside on an end wall 23 of a valve housing 24, which is integrally connected to the top wall 5 of the tank 2 within the tank 2, of the valve assembly 7. The plunger 21 has a central bore which accommodates a needle 25 which, at the end located on the side of the reservoir 14, has a sharp point and at the other end is secured in the end wall 23 of the valve housing 24. The plunger 21 can move over the needle 25. A flexible ring 26 made from soft material, such as a soft rubber, is arranged coaxially around the plunger 21.

In FIG. 2*b*, the cover 15 has been screwed fully onto the wall part 12. Screwing on the cover 15 causes the reservoir 14 to be pressed downwards in the direction of the tank 2. In the process, the reservoir 14 has pressed the plunger 21 downwards, counter to the spring force of the spring 22, and has also compressed the ring 26. In this compressed state, the ring 26 functions as a sealing ring between the reservoir 14 and the top wall 5 of the tank 2. As the plunger 21 is moving downwards, the sharp point of the needle 25 has been exposed and has punctured the thin wall of the reservoir 14, producing a connection between the interior of the reservoir 14 and the space surrounded by the wall of the reservoir 14, the top wall 5 of the tank 2 and the ring 26 and the interior of the valve housing 24, which is in open communication therewith via a space between the plunger 21 and the inner side of the bore in the top wall 5 and/or a space between the plunger 21 and the needle 25. The pressure in the valve housing 24 is then the same as in the reservoir 14.

As can be seen from FIG. 2*a, b*, there is an opening 31 in the end wall 23 of the valve housing 24, connecting the interior of the valve housing 24 to the interior of the tank 2. This opening 31 can be closed off by a valve body 32 which is located inside the valve housing 24 and can interact in a sealing manner with the edge of the opening 31, which functions as a valve seat. The valve body is pressed onto the valve seat by a spring 32. The valve body 32 is provided with an actuating pin 34 which extends through the opening 31 and into the interior of the tank 2.

FIG. 2*c* shows the state in which the volume of the gas 10 in the tank 2 is dropped to such an extent that the float 8 floating on the liquid 9 is in contact with the actuating pin 34 of the valve body 32 and the valve body 32 has lifted off its seat (the edge of the opening 31), counter to the spring force of the spring 33 and the gas pressure in the valve housing 24. As a result, a connection has been produced between the interior of the valve housing 24 and the interior of the tank 2, so that gas can flow out of the reservoir 14, via the valve housing 24, into the interior of the tank 2. In this way, the quantity of gas 10 in the tank 2 is topped up from the reservoir 14 until the pressure of the gas 10 has pressed the liquid level 11 so far downwards that the float 8 comes off the actuating pin 34 and the opening 31 is closed off again by the valve body 32.

FIGS. 3*a–f* provide a more detailed illustration of the operation of the expansion tank shown in FIG. 1.

FIG. 3*a* reveals how the reservoir 14 is positioned, and FIG. 3*b* shows how the connection is produced between the interior of the reservoir 14 and the interior of the valve housing 24. The situations shown in FIGS. 3*a* and 3*b* correspond to those shown in FIGS. 2*a* and 2*b*.

FIGS. 3*c* and 3*d* show how the tank 2, which is connected to a pipe system (not shown), fills up with liquid 9 when the pipe system is filled with liquid until the float 8 comes into contact with the actuating pin 34 of the valve body 32 and the valve body 32 lifts off its seat (FIG. 3*d*). The situation illustrated in FIG. 3*d* corresponds to that shown in FIG. 2*c*. Gas flows out of the reservoir into the tank 2 until the pressure of the gas 10 in the tank 2 is in equilibrium with the pressure in the pipe system to which the tank 2 is connected.

During the filling procedure, the maximum pressure is reached in the pipe system at the instant at which the float 8 comes free of the actuating pin 34 again and the valve formed by the valve body 32 and the seat is closed again under the influence of the spring 33, so that the flow of gas out of the reservoir 14 is blocked. From that instant onward, there is sufficient pressurized gas 10 in the tank 2 for the expansion tank 1 to operate successfully.

When the volume of the liquid 9 which is present in the pipe system decreases, as can be seen in FIGS. 3*e* and 3*f*, the pressure of the gas 10 remains sufficient. When the bottom position of the float 8 is reached, in the embodiment of the expansion tank 1 illustrated, gas can pass out of the tank 2 into the pipe system. However, the quantity of gas 10 which has remained in the tank 2 can be restored to its proper level when, in a later stage, in the event of an increase of the volume of liquid in the pipe system, the float 8 once again comes into contact with the actuating pin 34 of the valve body 32, as illustrated in FIG. 3*d* (and FIG. 2*c*).

The valve assembly 7 is preferably designed in such a manner that, when the expansion tank is operating, the reservoir 14 can easily be replaced without this affecting the action of the expansion tank. After the cover 15 has been removed, the reservoir 14 can be taken out of the space 13. In the process, the plunger 21 is pressed upwards by the spring 22, closing up the bore in the top wall 5 of the tank 2, so that it is impossible for any gas to escape from the tank 2. Then, a new reservoir 14 can be put in place and the cover 15 can be screwed back onto the wall part 12.

The possibility of replacing the reservoir 14, and a pressurized gas source in general, represents a major advantage compared to traditional expansion tanks, in which the entire expansion tank has to be replaced if the stock of gas in the tank is insufficient.

FIGS. 4*a–f* illustrate the same situations as in FIGS. 3*a–f*, but with a slightly different embodiment of the expansion tank 1. The expansion tank 1 is provided with a reservoir 41 containing pressurized gas which forms an integral part of the expansion tank 1 and is separated from the actual expansion tank (tank 2) by a partition wall 42, in which the second connection opening is incorporated. This second connection opening can be closed and opened by a valve 43 arranged at the location of the opening. The valve assembly 43 is provided with an actuating pin 44, similar to the actuating pin 34 of the embodiment shown in FIGS. 1–3. The reservoir 41 can be filled with pressurized gas via a filling opening 45 in the wall of the reservoir 41.

FIGS. 5*a, b* show a cross section through another embodiment of the expansion tank according to the invention. The expansion tank 51 is substantially a traditional expansion tank with a substantially closed tank 52 having a liquid space 53 and a gas space 54, which are separated by a flexible membrane 55. The membrane 55 moves with the interface between liquid and gas in the tank 52, so that the membrane 55 per se can be considered as a movable element which is designed to move with the interface between liquid and gas in the tank 52. The tank 52 is provided with a first connection opening 56 provided for connecting the expansion tank 51 to a pipe system (not shown) which is filled or is to be filled with liquid. In the top wall 57 there is a second connection opening 58 for connecting the expansion tank 1 to a source of pressurized gas, in this case a reservoir 59 containing pressurized gas. This opening 58 can be opened and closed by a valve assembly 60 which is arranged at the location of the second connection opening 58 and is illustrated in more detail and on an enlarged scale in FIGS. 6*a,b*.

As can be seen from FIGS. 6*a,b*, a connection piece 61 is arranged on the top wall 57 of the tank at the location of the second connection opening 58. A reservoir 59 containing pressurized gas can be connected to this connection piece 61. For this purpose, the connection piece 61 is provided with a bore 62 which is provided with an internal screwthread and into which a connection nipple 63, provided with an external screwthread, of the reservoir 59 can be screwed. A sealing ring 64 is responsible for the required sealing. When the connection nipple 63 has been completely screwed into the bore 62, a shut-off valve 64 which is present in the connection nipple 63 is opened by a pin 65 mounted in a fixed position in the connection piece 61, with the result that pressurized gas can flow out of the reservoir 59 into the interior of the connection piece 61.

The connection opening 58 can be closed off by a valve assembly having a valve body 66 which interacts with the edge of the connection opening 58, which functions as a valve seat. The valve body 66 is pressed onto the valve seat by a spring 67. An actuating pin 68 extending through the connection opening 58 is secured to the valve body 66; the membrane 55 can lift the valve body 66 off the seat and open the connection opening 58 by means of this actuating pin 68.

On the other side, the spring 67 presses against a valve body 69 of another valve 70, which acts as a nonreturn valve, as will be explained in more detail below.

When the reservoir 59 is connected to the connection piece 61 and the connection opening 58 is closed off by the valve body 58, the pressure of the gas in the reservoir 59 also prevails in the interior of the connection piece. When the stock of gas in the tank 52 drops to such an extent that the membrane 55 pushes the actuating pin 68 upwards and as a result lifts the valve body off its seat, pressurized gas flows out of the reservoir 59 into the tank 52. This state is illustrated in FIG. 5*b* and FIG. 6*b*. When the stock of gas in the tank 52 has been topped up, the membrane 55 becomes clear of the actuating pin 68 and the connection opening 58 is closed again.

In this embodiment of the expansion tank according to the invention too, it is easy to replace the reservoir 59 during operation without this affecting operation of the tank. When the reservoir is unscrewed from the connection piece, the valve 70 prevents gas from escaping from the tank 52. After another reservoir 59 has been fitted, the situation is as illustrated in FIGS. 5*a* and 5*b*.

In addition to the embodiments of the expansion tank according to the invention which have been described above, further embodiments are possible within the scope of the invention and lie within the scope of the person skilled in the art without being described in more detail here.

The float may be designed differently, for example as a float which does not function as a separating element.

The reservoir containing pressurized gas may also be located remotely from the expansion tank and may be connected via a pipe to the second connection opening with the valve of the expansion tank.

The actuating pin of the valve assembly may be extended by a rod-like element with a certain length which projects into the tank. This rod-like element is operated by the movable element in the tank. In this embodiment the valve assembly can be operated and gas can be supplied at another level of the liquid in the tank, i.e. before almost all of the gas has disappeared from the tank. To prevent that components are damaged the rod-like element may be made flexible. In embodiments of the tank in which the movable element is a float, the float may be mounted on the free outer end of the rod-like element.

The expansion tank may also be designed in such a manner that in the situation in which all or virtually all of the liquid has flowed out of the expansion tank as a result of the volume of the liquid in the pipe system to which the expansion tank is connected decreasing considerably, for example as a result of the cooling of the liquid or as a result of a leak, the first connection opening is closed off by the movable element (float, rigid separating element, membrane) in the expansion tank.

When an expansion tank according to the invention to which a pressurized gas source is connected is being used, whenever the quantity of gas in the expansion tank becomes insufficient, gas will once again be supplied from the pressurized gas source to the expansion tank in the manner described above.

What is claimed is:

1. An expansion tank which is intended to be connected to a pipe system which is filled or is to be filled with liquid, comprising a substantially closed tank having at least a first connection opening for connection to a liquid pipe, a second connection opening for connection to a source of pressurized gas, and an element which can move inside the tank and is designed to move with the interface between liquid and gas in the tank, the tank being provided, at the location of the second connection opening, with a valve assembly which can open and close the second connection opening and can be actuated by the movable element in the tank.

2. The expansion tank of claim 1, in which the source of pressurized gas is a reservoir which is connected or is to be connected to the second connection opening and comprises a stock of pressurized gas.

3. The expansion tank of claim 2, in which the reservoir containing pressurized gas is an integral part of the expansion tank and is separated from the actual expansion tank by a partition wall in which the second connection opening is incorporated.

4. The expansion tank of claim 2, in which the reservoir containing pressurized gas is a separate reservoir.

5. The expansion tank of claim 4, in which the reservoir containing pressurized gas is or can be accommodated in a space which is at least partially surrounded by a wall part connected integrally to the wall of the expansion tank and which is separated from the actual expansion tank by means of a partition wall in which the second connection opening is accommodated.

6. The expansion tank of claim 5, in which the partition wall is provided, at the location of the second connection opening, with a connecting member for producing a connection between the interior of the reservoir containing pressurized gas and the second connection opening when the reservoir containing pressurized gas is being placed in the space which is intended for it.

7. The expansion tank of claim 6, in which the reservoir containing pressurized gas is a thin-walled disposable reservoir, and the connecting member comprises a puncturing member for puncturing the wall of the reservoir containing pressurized gas when it is being placed in the space which is intended for it, in such a manner that a connection is produced between the interior of the reservoir containing pressurized gas and the second connection opening.

8. The expansion tank of claim 4, in which the reservoir containing pressurized gas is or can be connected to the tank via a connection piece which is fitted to the tank on the outer side at the location of the second connection opening.

9. The expansion tank of claim 4, in which the valve assembly is provided with means for preventing gas from flowing out of the tank when the reservoir containing pressurized gas is not connected to the tank.

* * * * *